United States Patent [19]

Ali

[11] 4,004,316

[45] Jan. 25, 1977

[54] BUFFING AND POLISHING DEVICE

[76] Inventor: Gregory F. Ali, 2855 Locke, Beavercreek, Ohio

[22] Filed: June 13, 1975

[21] Appl. No.: 586,797

[52] U.S. Cl. ..... 15/230.16

[51] Int. Cl.[2] ..... B24D 13/06

[58] Field of Search ..... 15/179, 181, 183, 230, 15/230.1, 230.14, 230.16, 230.17, 230.19; 51/334–337, 364, 365

[56] References Cited

UNITED STATES PATENTS

| | | | |
|---|---|---|---|
| 558,855 | 4/1896 | Stauder | 15/183 |
| 619,134 | 2/1899 | Campbell | 15/183 |
| 1,106,833 | 8/1914 | Painter | 15/230.17 UX |
| 1,323,969 | 12/1919 | Dilg | 15/230 |
| 1,559,080 | 10/1925 | Fields | 15/230.16 |
| 1,897,971 | 2/1933 | Johnston | 51/337 |
| 1,903,520 | 4/1933 | Sturgis | 15/198 X |
| 3,206,786 | 9/1965 | Sax et al. | 15/230.14 X |
| 3,289,234 | 12/1966 | Nelson | 15/181 X |
| 3,872,630 | 3/1975 | Ali | 51/334 |

FOREIGN PATENTS OR APPLICATIONS

| | | | |
|---|---|---|---|
| 629,746 | 8/1927 | France | 15/183 |
| 10,836 | 1/1902 | United Kingdom | 15/230.14 |
| 10,041 | 5/1893 | United Kingdom | 15/183 |

*Primary Examiner*—Daniel Blum
*Attorney, Agent, or Firm*—Jerome P. Bloom

[57] ABSTRACT

A buffing or polishing device characterized in its preferred embodiment by a hub comprised of a pair of generally dished or cup-shaped segments mounted in base abutted relation and having the base portions thereof adapted to connect to and be fixed for rotation with a drive shaft. The hub segments are identically constructed to include both male and female portions which are interfit and interlocked as the hub segments are placed in base abutted relation. They also include pins which coaxially dispose to provide anchor elements around which strip-like buffing or polishing elements are looped to have their respective ends diverge as they project outwardly from the hub. With the arrangement described, the divergent ends of the strips mutually combine to dispose as circumferentially and relatively widely spaced pairs, the elements of each pair being slightly convergent as they project in a sense radially of and outwardly from the hub.

9 Claims, 5 Drawing Figures

BUFFING AND POLISHING DEVICE

BACKGROUND OF THE INVENTION

This invention relates to a new and improved buffing and polishing device which is simply and uniquely constructed, economical to fabricate and assemble and endowed with the capability to run cooler and have a longer operating life than one would normally anticipate from its inexpensive construction.

Prior art devices directed to the same applications are particularly plagued with rapid wear and deterioration induced by the inherent vibration when power driven and the natural tendencies of the buffing or polishing medium to heat and rapidly wear in use.

These problems are overcome by concepts embodied in the present invention.

SUMMARY OF THE INVENTION

The embodiment of the present invention provides a uniquely formed structure which, dependent on the materials used, can be made to serve any type of buffing, polishing or similar function. They feature a simply fabricated hub characterized by a construction which enables buffing, polishing or like strips to have a looped or threaded connection therewith. The strips are interconnected with the hub so as to have a generally V-shaped configuration as the ends thereof are arranged to diverge as they are projected in a sense outwardly from the hub. As embodied in the V-shaped configuration, the buffing, polishing or like strips combine with adjacent strips to cause the end portions of the strips to dispose about the hub in pairs which are circumferentially and relatively widely spaced, with the elements of each pair in a slightly convergent relation as they project in a sense radially of and outwardly from the hub.

The hub of the invention is per se simply and uniquely constructed and characterized by being comprised of a pair of identical parts or segments which have a dished or cup-shape. The part or segment a plurality of which is used to form the hub features, in connection therewith, a plurality of male and female portions arranged and designed to facilitate the interengagement and interlock of a plurality of such parts to form a complete hub.

It will be seen that a primary object of the invention is to provide an improved buffing or polishing device characterized by economy of fabrication, efficiency and satisfaction in use, adaptability to a wide variety of applications and no likelihood of malfunction.

Another object of the invention is to provide a buffing or polishing or like device characterized by a relative coolness in the operation thereof, the result of which is to reduce wear and achieve improved operating characteristics as contrasted to similarly applied devices of the prior art.

An additional object of the invention is to provide a unique buffing or polishing device wherein a hub may be simply formed of two identical parts.

An additional object of the invention is to provide a buffing, polishing or like device characterized by a hub structure embodying a series of circumferentially spaced anchor elements serving as means about which buffing, polishing or like strips may be looped or threaded to have their ends project outwardly therefrom and caused to assume a generally V-shaped configuration as intermediate portions thereof are contained by the configuration of said hub.

An additional object of the invention is to provide a buffing, polishing or like device possessing the advantageous structural elements and assembly and the inherent meritorious characteristics herein described and obvious therefrom.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the drawings wherein is shown one but not necessarily the only form of embodiment of the invention, FIG. 1 is a perspective view of a buffing, polishing or similar device as constructed in the present invention;

Like parts are indicated by similar characters of reference throughout the several views.

Figures 1, 2, 3, 4, 5:
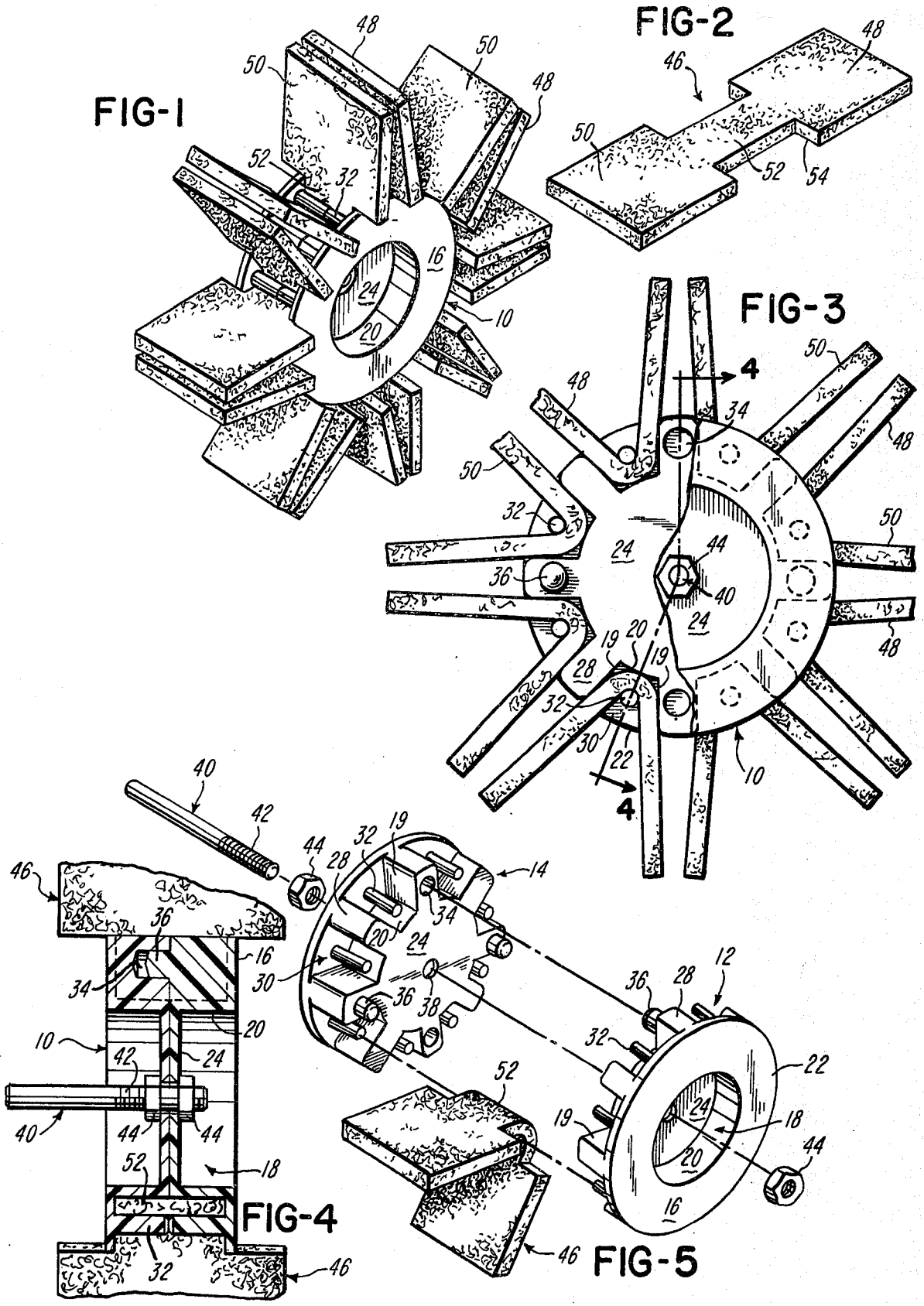
FIG. 2 is a plan view of a buffing, polishing or similar strip in the form in which it appears prior to application to the device of FIG. 1.
FIG. 3 is a side elevation view of the device of FIG. 1, partly broken away to show detail of the mounting of the strip element in accordance with the embodiment of the invention.
FIG. 4 is a sectional view taken on line 4—4 of FIG. 3.
FIG. 5 is an exploded view of the assembly of FIG. 1.

Referring to the drawings, a device in accordance with the present invention includes a hub 10 formed of two identically fabricated parts or hub segments to which are applied the reference numerals 12 and 14. Since the parts 12 and 14 have an identical configuration, the description of one thereof will suffice for an understanding of both, as well as the nature and character of their assembly to form the hub 10.

In the example illustrated, the part 12 is molded to a configuration that there is defined in one face 16 thereof a dished or cup-like recess 18. The recess 18 is peripherally bounded by a cylindrically configured wall structure 20 about the mouth of which is formed an integrally connected radially projected flange 22. The end of the wall structure 20 remote from the flange 22 is bridged by a thin disc-like wall segment 24 which forms the base of the recess 18. It is to be noted that the flange 22 has a flat annular configuration and the surface thereof remote from the wall segment 24 defines the face 16.

Integral with the outermost surface of the wall structure 20 is a series of circumferentially spaced radially oriented spoke-like projections 28. The spokes 28 extend the axial length of the wall structure 20 to have their end surfaces remote from the flange 22 lie in a plane parallel thereto, which plane is commonly occupied by the wall segment 24. At their ends adjacent the flange 22 the spokes 28 are formed to be integral with the flange 22 at the face thereof remote from the face 16.

It is to be noted that the radial outermost limits of the spokes 28 are coincident with the outer peripheral edge of the flange 22 and the side surfaces 19 of each spoke are parallel. Under such circumstances, the adjacent side surfaces of successively adjacent spokes form therebetween a pocket 30 the inner radial limit of which is defined by the cylindrical wall structure 20 between the spokes and the outer radial limit of which is defined by the outer peripheral edge of the flange 22. The one end of the pocket is thus bridged by the flange 22 while the opposite end is open. Formed integral with and projected perpendicularly from the face of the flange 22 remote from the face 16 in the approximate center of each pocket 30 is a pin-like structure 32 the projected end of which lies in a plane commonly occupied by the wall segment 24 defining the base of the recess 18.

In the embodiment illustrated in the drawings the spokes 28 are shown to be eight in number and each of a pair of diametrally opposite spokes have in the end surface thereof most remote from the flange 22 a cylindrical recess 34. A further pair of diametrally opposite spokes 28 in a line at right angles to those embodying the recesses 34 have projected from and perpendicular to their end surfaces most remote from the flange 22 a pin-like structure 36. The recesses 34 formed in and the pins 36 projected from the pairs of diametrally opposite spokes 28 which are in lines at right angles to each other are equidistantly spaced from the center of the wall segment 24, which center lies in the longitudinal axis of the cup-like structure projected from the rear of the flange 22 as above described and shown in the accompanying drawings. Moreover, the pins 36 are provided with a configuration to be complementary to the configuration of the sockets defined by the recesses 34.

As will be seen, this enables that one may readily use the identical parts 12 and 14 to form a complete hub assembly. On disposing the outermost faces of their wall segments 24 in adjacent, aligned and closely spaced relation and orienting the pins 36 which project from the co-planar surface portions of a pair of diametrally opposite spokes on one thereof in alignment with the recesses 34 defined in co-planar surface portions of the other thereof, the respective parts 12 and 14 may be brought together to establish their wall segments 24 in base abutted relation, in the course of which the pins 36 on one part may be press fit into the sockets defined by the recesses 34 in the other thereof. The parts are thereby frictionally locked in an interconnected relation. This places each pin 32 on one part in an axial aligned relation with and provides that it be a continuation of a pin 32 on the other part. As will be seen, each pair of coaxially related pins 32 form an anchoring device.

Each of the wall segments 24 have a central aperture 38 which in the frictional interlock of the parts 12 and 14 are placed in a directly aligned relation. This enables that a shaft-like element 40 may have one threaded end 42 thereof thrust through the apertures 38 in the base abutted wall segments 24 to have threadedly engaged therewith, in each of the recesses 18, a nut 44. It will be seen that the shaft-like element 40 may be clamped to the hub 10 by appropriate adjustment of the nuts 44 and so disposed thereby to project from the wall segments 24 in a line defining the central longitudinal axis of the hub, the opposite remote faces of which are defined by the faces 16 of the flange portions 22 of the hub parts 12 and 14.

The invention thus enables the unique formation of a hub structure which is comprised of two identical parts. It is believed that the economy of producing a hub in the fashion described as well as the simplicity of its assembly should be self-evident.

The hub structure described enables in the assembly thereof the application of buffing or polishing strips 46 to afford a unique buffing or polishing device in accordance with a preferred embodiment of the present invention. In the example illustrated, the strip 46 has an elongate generally rectangular form. It includes relatively wider end portions 48 and 50 interconnected at their adjacent ends by an intermediate strip portion 52 which is relatively narrower by reason of identical rectangular notches 54 formed in each of opposite sides of the strip which define its length. As shown, the width of the strip portion 52 is in correspondence with the spacing between the flanges 22 of the parts 12 and 14 as assembled to form the hub 10. In the process of assembly of the parts 12 and 14 to dispose their wall segments 24 in flush abutted relation a strip 46 is applied to one of the parts in each pocket 30 thereof to have its intermediate portion 52 loop or thread about the pin segment 32 in the pocket and center in the base thereof whereby to dispose the remote ends of the strip portion 52 immediately outward of the radial limits of the spoke surfaces 19 which define the outer radial limits of the pocket. Attention is directed to the fact that this disposes the wider end segments 48 and 50 of the strip portion immediately outward of the outer peripheral edges of the flange portions 22 of the parts 12 and 14 as the parts are brought together and interlocked as previously described. In the process of the parts being brought together and the pin segments 32 of the parts aligned, the central portions 52 of the strips 46 will each be then retained by a pair of aligned pins 32 and the inner edges of the strip portions 48 and 50 created by the notches 54 will limit against the outer edges of the flange portions 22. Each of the strips will assume a V-shaped configuration as the centers of the strips are anchored against the outer surface of the wall structure 20 and the ends thereof project equidistantly therefrom in a divergent relation determined by the orientation of the confining wall surfaces 19. Attention is directed to the fact that the width of the end portions 48 and 50 of the strips 46 as they dispose outwardly of the periphery of the hub is such that they bridge, overlap and bear against the outer peripheral edges of the flanges 22 in a manner to preclude their shifting. The strips 46 are thereby anchored to the hub 10 in a firmly and precisely determined relation and their assembly is simply effected in an obvious manner as described in the course of bringing together the identical parts 12 and 14 of the hub.

Referring to the drawings, it may be seen that, by reason of the V-shaped configuration imposed on the strips 46 by virtue of the nature and character of the hub assembly as the strips are anchored thereto, each strip 46 will provide that an end portion 48 thereof will dispose to form with an end portion 50 of a preceding strip a pair of generally radially projected, relatively adjacent, outwardly convergent padlike strip portions. As will be obvious, the strip portion 50 remote from a strip portion 48 which is in divergent relation thereto will similarly dispose with reference to a strip portion 48 of a following strip.

The assembly thus described provides that a plurality of relatively widely spaced pairs of rectangular pad-like strip portions having buffing, polishing or other surface treating characteristics, project radially outward of the hub 10 with the elements of each pair being convergently disposed by a bias of one to the other.

On suitably chucking the assembly to a driving medium, the hub with its interconnected and interlocked strips may be rotated. Depending on the direction of rotation, the leading strip portion of each convergent pair of end portions 48 and 50 may be applied, to the maximum extent of its outermost surface, to the material to be buffed, polished or otherwise surface treated. The treatment to be effected will in all cases depend on the physical characteristics or chemical impregnation of the strip ends. Due to the fact that there is a wide separation of the convergent pairs of strip ends which project outwardly from the hub 10, the operation will be relatively cool, there being adequate spacing for an air flow to be produced to maintain the surfaces of the material applied to the buffing, polishing or like function of the device relatively cool. Of course, as the leading strip end of a convergent pair has its leading surface applied for the intended purpose, the outer edge portion of the most adjacent surface of the backing strip portion will supplement the function thereof. It is of particular significance to note that the symmetrical construction of the hub enables that when the leading strip ends of the convergent pairs are substantially worn, one can simply reverse the ends of the hub on the shaft 40, in which event the trailing surfaces of the pairs of convergent strip ends become the leading surfaces.

Thus, the invention particularly as described, enables that the strips 46 and materials thereof may function in a cool and efficient manner. Not only is this advantageous for the materials embodied in the strips but for the surfaces to which the strips are applied. For such reasons the quality of the resultant operation is in all cases optimal.

From the foregoing, it will be seen that the invention does in fact afford means and methods for achieving uniquely and advantageously fabricated hub structures and, moreover, a most economical, most efficient and satisfactory assembly for buffing, polishing and various applications which require the use in conjunction with a rotating hub of relatively projected flexible work performing elements.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A buffing, polishing or like device including a hub structure comprised of a pair of substantially identical hub segments each of which includes a cylindrically configured hub portion the outer peripheral surface of which incorporates a series of circumferentially spaced, radially projected, longitudinally extending spokes and a radial flange, a plurality of pin means fixed to said flange to be generally perpendicular thereto and to extend between and in a spaced generally parallel relation to adjacent divergent side surfaces of an adjacent pair of said spokes, said segments including means for a coupling of one thereof to the other to produce said hub structure, said coupling means being arranged and configured to require a rotative movement of one said hub segments relative the other in order to achieve said coupling thereof, in the process of which said spokes, said flanges and the hub portions from which they project define a series of circumferentially spaced pockets which open outwardly from said hub structure and a plurality of strip-like buffing and polishing elements having their intermediate portions looped about the respectively associated pin means and anchored in said pockets and projected outwardly of said hub structure so formed.

2. A device as in claim 1 characterized in that said hub segments have an identical configuration.

3. A device as in claim 1 characterized in that said coupling means are formed to press fit, thereby to frictionally interlock said hub segments and produce a complete hub structure for said strip-like elements.

4. A device as in claim 1 characterized in that said flange on each said hub segment is to one end of said cylindrically configured hub portion, said spokes extend therefrom to the other end of said hub portion and said pin means also extend from said flange to the other end of said hub portion whereby in the coupling of said pair of hub segments the pin means fixed to the respective flanges thereof may be disposed in axially aligned pairs including pin means one of which provides a continuation of the other.

5. A device as in claim 4 wherein said coupling means are provided in connection with said spokes.

6. A device as in claim 4 characterized in that said coupling means are of both male and female configuration, complementarily shaped and embodied in connection with portions of said spokes remote from said flanges.

7. A device as in claim 6 wherein said hub segments are of identical size and configuration.

8. A device as in claim 7 wherein said strip-like elements have a rectangular configuration and include opposite side notches in an intermediate portion thereof, said notches being rectangular to reduce said strip-like elements in said intermediate portion thereof, said reduced portion of said strip-like elements providing that one thereof may be placed in each said pocket in said hub structure to underlie said pin means which locate therein and to otherwise have the opposite ends thereof freely extend from said pocket and to lie against the divergent side walls of the pocket as they project outwardly of said hub structure, the arrangement providing that each said strip-like element in connection with said hub structure is anchored thereto solely by the overlying relation of an intermediate portion thereof by pin means.

9. A device as in claim 8 characterized in that said hub segments have a cup shaped configuration the bases of which in a coupling thereof will be in an end butted relation with the interconnected flanges disposed at the remote ends of the hub structure so provided.

* * * * *

UNITED STATES PATENT AND TRADEMARK OFFICE

CERTIFICATE OF CORRECTION

PATENT NO. : 4,004,316

DATED : January 25, 1977

INVENTOR(S) : Gregory F. Ali

It is certified that error appears in the above-identified patent and that said Letters Patent are hereby corrected as shown below:

In the Title, "DEVICE" is corrected to read -- WHEEL --.

Col. 1, line 27, -- V -- should be in quotes.

Col. 5, line 27, a comma is inserted following "invention".

Signed and Sealed this

Tenth Day of May 1977

[SEAL]

*Attest:*

RUTH C. MASON
*Attesting Officer*

C. MARSHALL DANN
*Commissioner of Patents and Trademarks*